US005440823A

United States Patent [19]

Willgohs

[11] Patent Number: 5,440,823

[45] **Date of Patent: * Aug. 15, 1995**

[54] PROCESS AND APPARATUS FOR EFFICIENTLY DRYING WET-MILLED CORN GERM AND FOR PROCESSING OTHER MATERIALS

[75] Inventor: Ralph H. Willgohs, Covington, Ohio

[73] Assignee: The French Oil Mill Machinery Company, Piqua, Ohio

[ * ] Notice: The portion of the term of this patent subsequent to Mar. 29, 2011 has been disclaimed.

[21] Appl. No.: 208,293

[22] Filed: Mar. 10, 1994

Related U.S. Application Data

[63] Continuation-in-part of Ser. No. 24,292, Mar. 1, 1993, Pat. No. 5,297,348.

[51] Int. Cl.[6] ..... F26B 3/08

[52] U.S. Cl. ..... 34/363; 34/370; 34/589; 34/169; 165/104.16

[58] Field of Search ..... 34/359, 360, 576, 363, 34/368, 370, 371, 582, 167–169, 585, 586, 589, 590, 591, 594; 165/104.16

[56] References Cited

U.S. PATENT DOCUMENTS

| | | | |
|---|---|---|---|
| 3,287,823 | 11/1963 | Vidali | 34/173 |
| 3,771,237 | 11/1973 | Hansen et al. | 34/57 A |
| 3,876,383 | 4/1975 | Vandenhoeck | 34/168 |
| 4,323,312 | 4/1982 | Glatt et al. | 34/57 A |
| 4,702,892 | 10/1987 | Betz | 165/104.6 X |

OTHER PUBLICATIONS

1989 Publication of FRENCH® Dryer/Cooler System.

1980 Publication of G. M. Rios et al entitled "Potential Improvements In The Field Of Large Particle Fluidization".

*Primary Examiner*—Denise L. Gromada

*Attorney, Agent, or Firm*—Jacox & Meckstroth

[57] ABSTRACT

A flowable solid material, such as wet-milled corn germ, is continuously fed into the upper portion of a large vessel having a cylindrical shell with a vertical axis and a series of vertically spaced horizontal decks. Each deck has concentrically spaced annular zones of holes or perforations, and heated air from a set of blowers and a gas-fired or steam heat exchanger is forced countercurrently or upwardly through the perforations to produce a recirculating bed of material above each deck with an upward spouting flow of the material above the zones of perforations and a downward flow of material between the zones of perforations. The recirculating material forming the lower beds is also heated by cylindrical steam heat exchangers which extend vertically between the zones of perforations, and the material is fed progressively downwardly through the vessel to form the beds and for discharge from the lowermost bed. Sweep arms rotate above the decks and below the heat exchangers, and after the heated air flowing upwardly through the decks and beds absorbs moisture from the material, the air is exhausted to a dual cyclone separator. The separator collects solid particles within the exhaust air, and the clean exhaust air is directed from the separator back to the blowers to form a closed cycle operation. The apparatus may also be used for cooling, treating or burning a flowable solid material.

25 Claims, 3 Drawing Sheets

PROCESS AND APPARATUS FOR EFFICIENTLY DRYING WET-MILLED CORN GERM AND FOR PROCESSING OTHER MATERIALS

Related Application

This application is a continuation-in-part of application Ser. No. 08/024,292, filed Mar. 1, 1993 now U.S. Pat. No. 5,297,348.

BACKGROUND OF THE INVENTION

In the processing of corn germ, there is produced a wet-milled corn germ which has a high moisture content, for example, between 50% and 55% moisture, and it is necessary to reduce this moisture content down to a substantially lower value, for-example, between 2% and 3%. Commonly, the moisture reduction is accomplished in a series of three or more rotary horizontal cylinders or drums each of which has a diameter of about 10 to 13 feet, a length of about 60 to 80 feet and encloses axially extending steam tubes. Each rotary drum also has internal vanes and is supported with its axis on a slight incline. Wet-milled corn germ material and heated air are fed or directed into the slightly higher end of the rotating drum, and internal vanes progressively feed the material axially through the drum and shower the material over the steam tubes for heating the material and evaporating the moisture.

The drier corn germ material exits from the opposite end of each rotating drum along with the moisture laden hot exhaust air, and large diameter rotary seals are required for both ends of the rotating dryer drum. As a result of the large diameter of the rotary seals and the necessary clearance for the rotating elements, it is difficult to prevent the moisture laden hot air from escaping into the atmosphere and to prevent leakage of the corn germ material, especially from the discharge end of the rotary drum. This hot gas or air leakage and the heat loss from the rotary drum result in a relatively low recovery of energy from each dryer unit, for example, on the order of a 65% energy recovery. The leakage of the moisture laden hot air from the discharge end of each rotary drum dryer also results in the escape of objectionable odors into the atmosphere since the dryers are usually located outside of a building.

SUMMARY OF THE INVENTION

The present invention is directed to an improved process and apparatus for efficiently treating or drying or processing certain types of flowable solid materials and which is ideally suited for drying wet-milled corn germ and other similar agricultural products and materials having relatively large particles and classified within the Geldart type "D" class of materials. The process and apparatus of the invention also provide for a totally sealed closed cycle operation and for a significant increase in energy recovery as well as the substantial elimination of escaping gasses with objectionable odors.

In accordance with one embodiment of the invention, wet-milled corn germ having a moisture content of about 52%, or a similar material which requires drying, is fed into the upper portion of a large upright vessel. The vessel has a cylindrical shell enclosing a series of vertically spaced flat circular decks which surround a vertical drive shaft supporting a set of sweep arms directly above each deck. Each deck has horizontally spaced zones of holes or perforations, preferably in the form of concentrically spaced rings, and some of the decks are provided with concentrically spaced annular steam jackets which extend vertically between the annular zones of perforations.

High velocity heated air is forced upwardly through the perforations within each deck to produce a recirculating spouting bed of material above the deck with an upward flow of the material above the zones of perforations and a downward flow of material within the spaces defined between the zones of perforation. Each bed of material is agitated adjacent each of the decks by the rotating sweep arms, and the material flows out of each bed over a vertically adjustable weir gate or dam and is directed to the adjacent underlying bed of material through a driven rotary valve which forms an air lock between the adjacent beds of material. The upward or countercurrent flow of heated air absorbs the moisture in the recirculating material and is discharged from the upper portion of the vessel into a dual cyclone separator unit which separates and collects any solids in the exhaust gas or air and directs the clean air back to the blowers and gas-fired or steam heat exchanger which supply heated air to the vessel below each of the decks.

Other features and advantages of the invention will be apparent from the following description, the accompanying drawings and the appended claims.

DESCRIPTION OF THE PREFERRED EMBODIMENT

Figure 1:
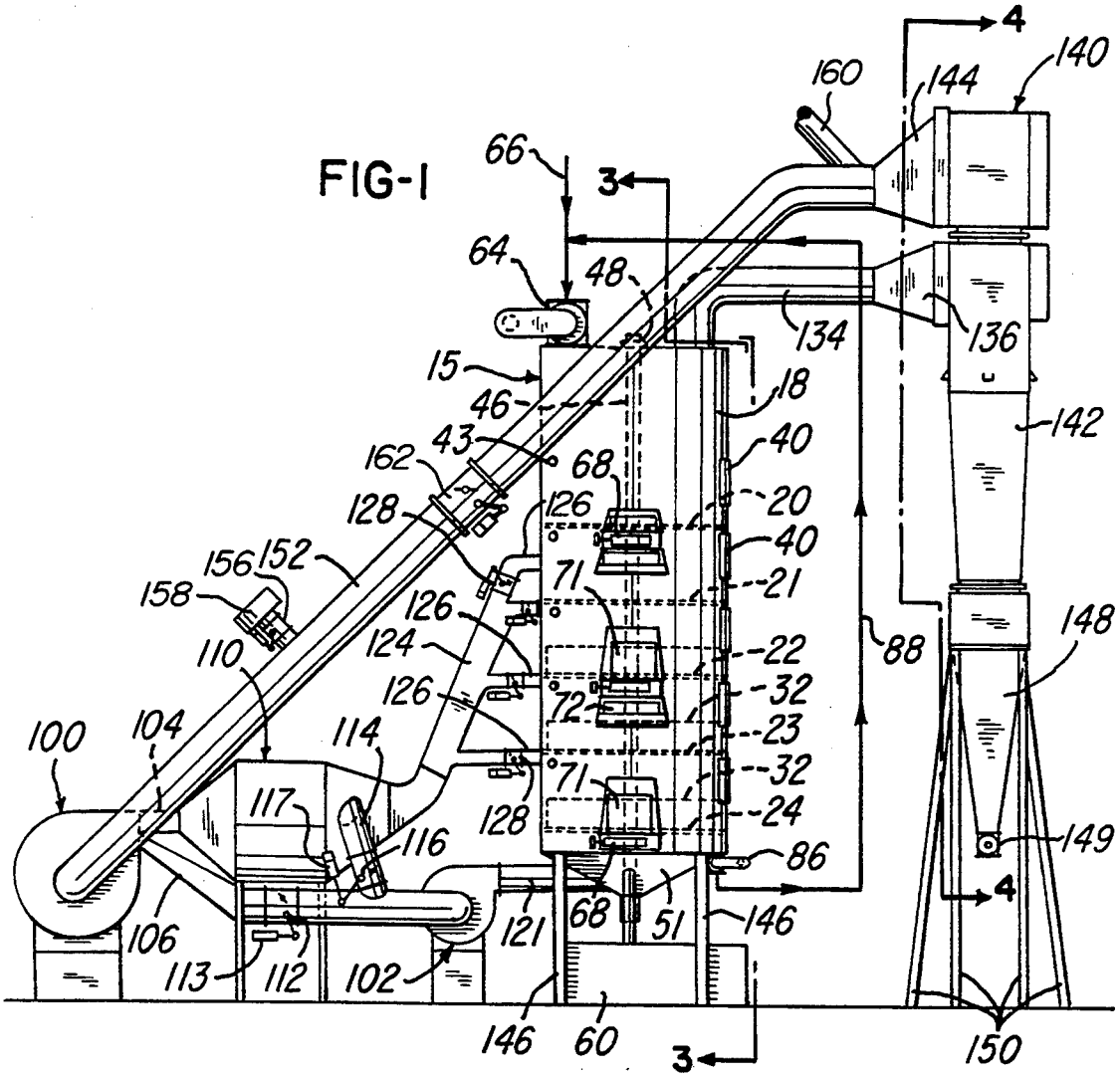
FIG. 1 is a general elevational view of a dryer system or apparatus constructed and assembled in accordance with the invention.

FIG. 1 illustrates a system or apparatus constructed in accordance with the invention and which includes a dryer container or vessel 15 having a cylindrical shell 18 with a vertical axis and a diameter of about 12.5 feet and a height of about 40 feet. The shell 18 encloses a series of vertically spaced generally flat decks 20–24 each of which has a center hole and concentrically spaced annular rings or zones of perforations. For example, referring to FIGS. 6 and 7, the bottom deck 24 is illustrated with six concentrically spaced rings or zones 27 of holes or perforations 28 each having a predetermined diameter, for example 3/16 inch. The holes within the annular zones 27 of the decks 20–23 have progressively larger diameters in an upward direction so that the holes within the top deck 20 have a diameter of about 1 inch, and the holes within the middle deck 22 have a diameter of about ½ to ¾inch.

Spaced above each of the lower three decks 22–24 is a series of stainless steel heat exchangers 32 (FIG. 7) in the form of concentrically spaced cylindrical steam jackets 34 each of which defines interconnected spaced steam passages 36. The steam passages 36 within each cylindrical jacket 34 are connected by top and bottom header passages (not shown) with the top header passage receiving steam through a steam inlet tube 38 (FIG. 5) and the bottom header passage connected to a tube 39 for removing steam condensate from heat exchangers.

Figure 3:
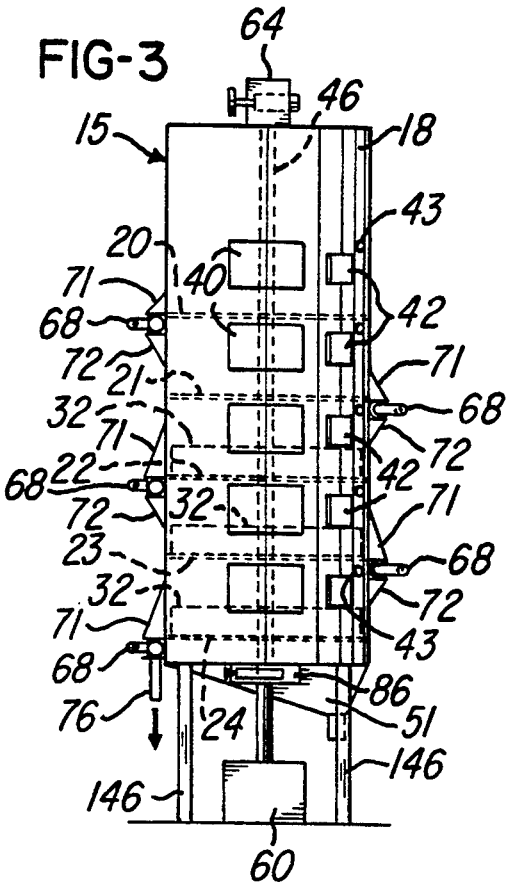
FIG. 3 is an elevational view of the dryer vessel taken generally on the line 3—3 of FIG. 1.
Figure 6:
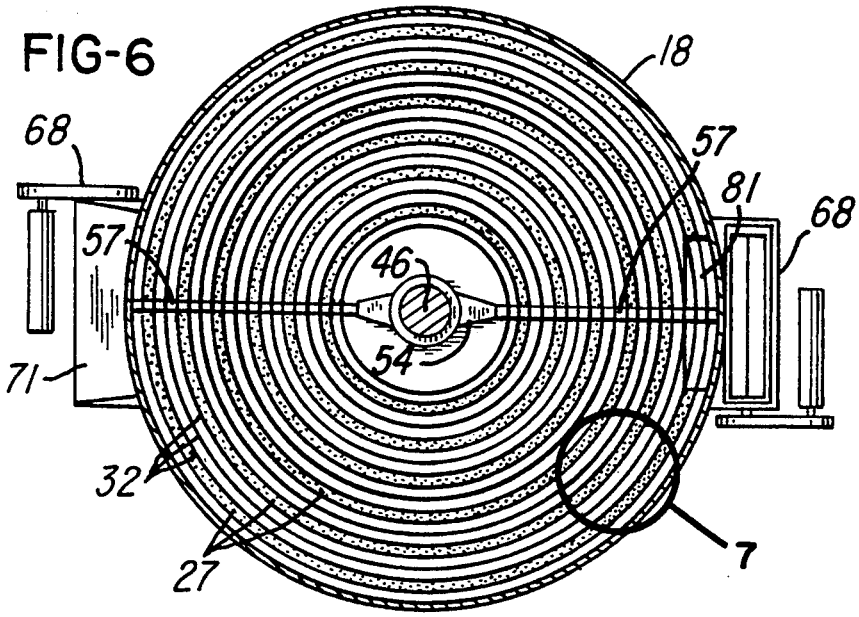
FIG. 6 is a horizontal section of the dryer vessel taken generally on the line 6—6 of FIG. 5.
Figure 8:
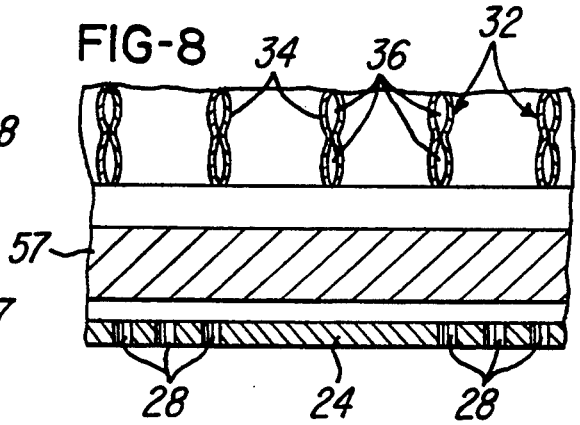
FIG. 8 is an enlarged fragmentary section taken generally on the line 8—8 of FIG. 7.

As shown in FIG. 8, two concentric cylindrical steam jackets 34 are spaced above the bottom deck 24 and extend vertically on opposite sides of each zone 27 of perforations 28. There are also concentric cylindrical steam jackets 34 spaced above the deck 24 and located between the zones 27 of perforations and above the annular area of the deck 24 without perforations. While the concentrically spaced steam jackets 34 are illustrated in FIG. 6 as annular rings, the steam jackets 34 may be constructed in part-cylindrical or arcuate sections in order to insert or remove the steam jackets 34 after removing a corresponding service access panel 40 (FIG. 3) within the shell 18 above each of the decks 20–24. The shell 18 is also provided with a manway 42 and a sight glass 43 above each of the decks 20–24, as also shown in FIG. 3.

Figure 5:
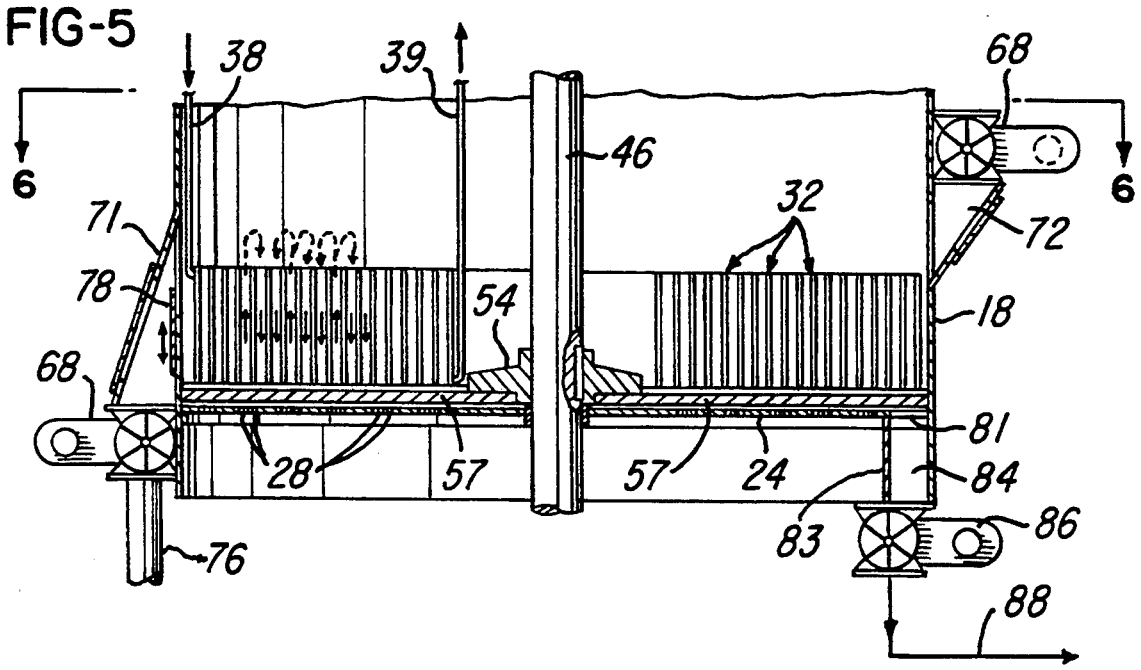
FIG. 5 is an enlarged vertical section of the lower deck assembly of the dryer vessel shown in FIGS. 1 and 3.

A drive shaft 46 (FIG. 5) extends vertically through the center holes within the decks 20–24 and is rotatably supported by a bearing 48 (FIG. 1) mounted on the top wall of the vessel 15 and a bearing (not shown) mounted on a bottom clean out hopper 51 for the vessel 15. The shaft 46 supports a series of vertically spaced hubs 54 (FIG. 5) directly above each of the decks 20–24, and each hub 54 supports a pair of diametrically opposed sweep arms 57 (FIG. 6) each of which preferably has a generally wedge-shaped or air foil cross-sectional configuration. The drive shaft 46 is driven by a motor and gear box drive unit 60 (FIG. 1). One source for the unit 60 is the Falk Corporation. As shown in FIGS. 5 and 8, when the shaft 46 is driven, the sweep arms 57 rotate directly above each of the decks 20–24 and directly below the steam heat exchangers 32 spaced above the lower decks 22–24.

A motor driven rotary feed valve 64 (FIG. 1) is mounted on tile top wall of the vessel 15 for continuously feeding material, such as wet-milled corn germ, from a supply conduit or line 66 into the upper portion of the vessel 15 above the top deck 20. One source for the rotary feed valve 64 is Kice Metal Products, Inc. Referring to FIG. 3, another rotary feed valve 68 is mounted on the shell 18 adjacent each of the decks 20–24 and connects with an upper duct 71 and a lower duct 72 for feeding material received from above each deck to the space above the adjacent lower deck. The lowermost rotary feed valve 68 feeds material above the lowermost deck 24 to a discharge conduit or line 76 (FIGS. 3 and 5). As shown in FIG. 5, a vertically adjustable arcuate panel 78 forms an overflow dam of weir gate within each of the upper ducts 71 for controlling the flow through a discharge opening or port within the shell 18 at the upper end of each duct 71.

Referring to FIGS. 5 and 6, an opening 81 is formed within the bottom deck 24 adjacent the shell 18, and a duct 83 extends downwardly between the deck 24 and the hopper 51 to define a discharge passage 84 which connects with a rotary feed valve 86. A conveyor 88 (FIG. 1) connects the valve 86 back to the material supply line 66 to provide for back-mixing material, as will be described later. As apparent from FIGS. 3 and 5, the rotary feed valves 68 and the corresponding upper ducts 71 and lower ducts 72 and the corresponding openings within the shell 18 for the ducts, are located in an alternating manner on diametrically opposite portions of the shell 18 so that the material is fed in a serpentine-like manner downwardly through the vessel 15 and onto the decks 20–24. The lowermost rotary feed valve 68 (FIG. 5) for the bottom deck 24 provides for discharging material from the vessel 15 and into the discharge conduit or line 76.

Referring to FIG. 1, as the wet material is fed from the supply line 66 into the vessel 15 through the rotary feed valve 64 and downwardly in a serpentine-like manner through the vessel 15, heated air is blown countercurrently or upwardly through the vessel 15 from a primary motor driven blower unit 100 and a secondary or booster motor driven blower unit 102. The outlet 104 of the blower unit 100 is connected by a duct or conduit 106 to the inlet of the secondary blower unit 102 and is also connected to the inlet of a gas-fired or steam heat exchanger 110. The primary blower unit 100 is driven by a 600 horsepower electric motor, and the secondary blower unit 102 is driven by a 125 horsepower electric motor, both of which are commercially available, for example, from the Buffalo Forge Company.

The heat exchanger 110 is available from different sources, for example, from Aerofin Corporation. The outlet blower conduit 106 includes a rotary damper valve 112 actuated by a fluid cylinder 113, and the heat exchanger 110 has an outlet duct 112 connected by a lateral duct or conduit 114 to the conduit 106. Another damper valve 116 is located within the conduit 114 and is actuated by a fluid cylinder 117 for selectively controlling the flow of heated air from the heat exchanger 110 to the inlet duct 106 for the secondary blower unit 102. The outlet of the secondary blower unit 102 is connected by a duct or conduit 121 to the bottom hopper 51 of the vessel 15 so that air discharged from the combined blower units 100 and 102 is forced upwardly through the holes 28 within the bottom deck 24. The outlet duct 112 of the heat exchanger 110 is also connected to the vessel 15 below each of the decks 20–23 by a manifold duct or conduit 124 and a set of laterally extending ducts or conduits 126 each having a damper valve 128 operated manually or by a fluid cylinder.

Figure 4:
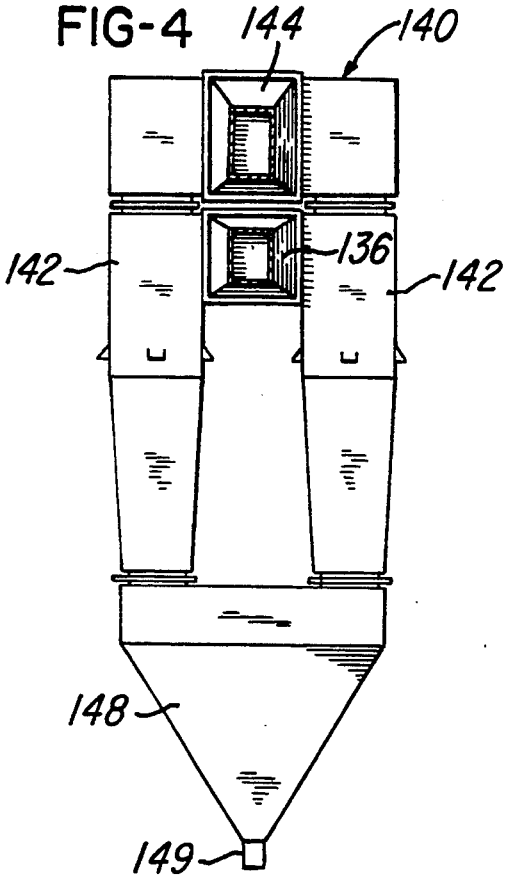
FIG. 4 is an elevational view of a dual cyclone separator and taken generally on the line 4—4 of FIG. 1.

The upper end portion of the dryer vessel 15 is connected by a discharge duct or conduit 134 (FIG. 1) to the inlet 136 of a dual cyclone separator unit 140 (FIGS. 1 and 4). One source for the cyclone separator unit 140 is the Model XQ465-60-2 manufactured by Fisher-Klosterman, Inc. The unit 140 includes a pair of cyclones 142 which have tangential inlets connected to the gas inlet 136 and corresponding top outlets connected to an outlet duct 144. The lower ends of the cyclones 142 are connected by a hopper collector 148 (FIG. 4) having a bottom outlet valve 149. As shown in FIG. 1, the vessel 15 is supported from a floor by four uniformly spaced vertical legs 146, and the cyclone separator unit 140 is supported by a set of four slightly inclined legs 150.

Figure 2:
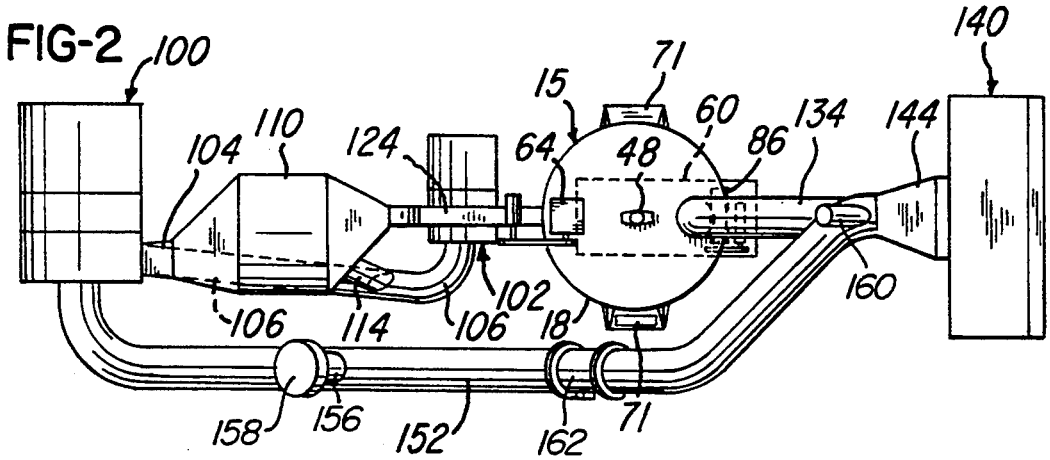
FIG. 2 is a plan view of the apparatus shown in FIG. 1.

Referring again to FIG. 1, the outlet duct 144 for the cyclone separator unit 140 is connected by a duct or conduit 152 to the inlet of the primary blower unit 100 and thereby forms a closed loop air system for the dryer vessel 15 and the cyclone separator unit 140. Make-up air for the system is supplied to the conduit 152 through a fresh air inlet 156 (FIGS. 1 and 2) within the conduit 152 and covered by a movable closure 158. A conduit 160 extends from the upper portion of the conduit 152 to an energy recovery system (not shown), and a damper valve 162 controls the proportion of air which is recirculated within the conduit 152 to balance the system.

In the processing or drying of wet-milled corn germ material, the material is fed into the vessel 15 with a moisture content of about 50% to 57% before backmixing, as mentioned above. The material initially forms a bed on the upper perforated deck 20 and then progressively forms a bed on each of the decks 21–24 under the top deck 20. The air discharged from the blowers 100 and 102 and heated by the heat exchanger 110 produces a countercurrent flow of hot air upwardly through the decks 20–24 and with the upward velocity of the heated air through the perforations 28 being substantially greater, for example, five or six times or more than the terminal velocity of the larger solid particles within the corn germ material.

Figure 7:
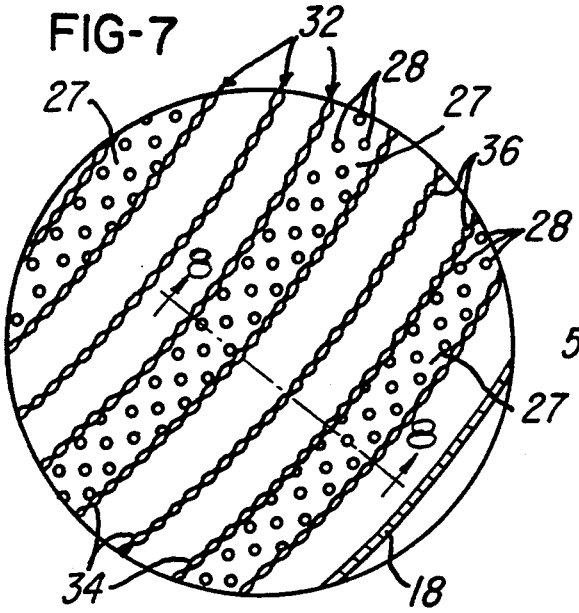
FIG. 7 is an enlarged fragmentary section of the lower deck assembly shown in FIG. 6.

As a result of this high velocity upwardly flow of air through the decks 20–24, a spouting bed of material is formed above each of the decks 20–24. In addition, as a result of the spaced relation of the zones 27 of perforations 28, as shown in FIGS. 6 and 7, the material forming each bed flows upwardly above each zone 27 and downwardly within the spaces between the zones 27 so that the material is provided with substantial recirculation within each bed. As the material flows over the dam or weir gate 78 for each bed, the overflow material is fed downwardly by the corresponding rotary feed valve 68 into the material bed recirculating above the adjacent lower deck. The recirculated material forming the beds above the lower three decks 22–24 is also provided with substantial heat from the steam heat exchangers 32 as the material flows upwardly and downwardly between the heat exchangers.

As the drier corn germ material overflows the bed above the lowermost deck 24 and is fed into the discharge conduit 92, the material has a substantially lower moisture content, for example, on the order of 20% moisture or lower. As the heated air flows upwardly through the decks 20–24 and the recirculating beds above the decks, the air absorbs substantial moisture from the material and exits through the exhaust duct 134 with a wet bulb temperature of about 205° F. After the solid particles are separated from the exhaust gas or air within the cyclone separator unit 140, the clean air returns to the primary blower 100 through the duct 152.

The solid particles which collect in the hopper 148 are periodically removed from the hopper through the valve 149. While not shown, it is understood that all of the components shown in FIG. 1 and which conduct either the hot gases or the material being dried are surrounded by a suitable insulation material in order to minimize heat loss from the system to the atmosphere. In addition, the damper valves 112, 116 and 128 provide for precisely controlling or adjusting the flow of heated air upwardly through each deck 20–24 in order to obtain the optimum drying of the material. Preferably, the air flowing upwardly through the decks 124 and 126 is heated by the heat exchanger 110 to a temperature of about 325° F.

In order to prevent clogging of the perforations within the top deck 20 by the wet-milled corn germ, especially during start up of the system, a portion of the drier material is collected from the lower deck 24 and is fed through the rotary valve 86 and by the conveyor 88 to the supply line 66 for back-mixing some of the drier material with the wet supply material. The conveyor 88 may be any form of conveyor which can handle the drier material, for example, a rotary auger conveyor or an air conveyor.

From the drawings and the above description, it is apparent that a drying process and dryer system or apparatus constructed in accordance with the present invention provides desirable features and advantages. For example, the substantial recirculation of the material within the spouting beds above the decks 20–24, as produced by the spaced zones of perforations, provides for efficient transfer of heat to the material and for efficient moisture absorption by the upward flowing heated air. Furthermore, the apparatus provides for processing or drying a substantial flow of material, for example, on the order of 940 tons of material per day or about 78,500 pounds per hour, and is especially effective for drying wet materials having large particles and classified in the Geldart Class D classification. In addition, the system is totally sealed and provides for a closed cycle operation to avoid gas and material leaks. The apparatus also requires less steam per pound of wet material and provides for a significant increase in energy recovery by obtaining an energy recovery of 90% to 95% in comparison with a 65% energy recovery with a conventional rotary drum steam tube dryer as described above. The system or apparatus shown in FIG. 1 also requires significantly less floor space than required by a rotary drum dryer and essentially eliminates the escape of gases with objectionable odors. In addition, the apparatus of the invention may be used for cooling or treating or burning various flowable solid materials having large particles. For example, a grain material may be cooled by using the heat exchangers 32 for extracting heat from the material or a material such as granulated coal may be burned above a perforated deck 24 while the coal is recirculating between the heat exchangers 32 which are used to heat water or other fluid being circulated within the passages 36.

While the process and form of apparatus herein described constitute a preferred embodiment of the invention, it is to be understood that the invention is not limited to the precise process and form of apparatus described, and that changes may be made therein without departing from the scope and spirit of the invention as defined in the appended claims.

The invention having thus been described, the following is claimed:

1. A process adapted for continuously processing a flowable solid material, comprising the steps of feeding the material into a vessel and above a generally horizontal deck having across the deck horizontally spaced zones of closely arranged perforations providing for a substantial flow of gas through the deck and with the zones of perforations separated by spaces which substantially limit the flow of gas through the deck between the zones, blowing gas into the vessel and upwardly through the zones of perforations to produce a recirculating bed of the material above the deck with an upward flow of material above the zones of perforations and a downward flow of material within the spaces defined between the zones of perforations, processing the material while the material is flowing upwardly and downwardly within the bed above the deck, and feeding processed material from the bed out of the vessel.

2. A process as defined in claim 1 wherein the material within the bed is directed upwardly and downwardly between generally vertically extending and horizontally spaced panel-like heat exchangers, and directing a fluid through the heat exchangers.

3. A process as defined in claim 2 wherein the processing of the material comprise burning the material for transferring heat to the fluid flowing through said heat exchangers.

4. A process as defined in claim 2, and including the step of agitating the material above the deck and below the heat exchangers.

5. A process as defined in claim 1 wherein the zones of perforations within the deck and the separating spaces comprise generally concentrically spaced and generally annular zones and spaces to produce generally concentric annular zones of recirculating material.

6. A process as defined in claim 1 and including the step of providing the vessel with a plurality of vertically spaced decks each having the zones of perforations and spaces, blowing the gas upwardly through the perforations within each deck to produce the circulation of material, and feeding the material from the recirculating bed above an upper deck downwardly into the recirculating bed of material above a lower deck.

7. A process as defined in claim 1 and including the step of directing the gas from above the bed of material to a cyclone separator, separating solid particles of the material from the gas within the separator, and directing gas from the separator to the gas blown into the vessel to form a recirculating gas flow system.

8. A process as defined in claim 1 and including the step of heating the gas prior to directing the gas into the vessel.

9. A process as defined in claim 1 and including the steps of directing a portion of the material downwardly through the deck, and back-mixing the material directed downwardly through the deck with the material fed into the vessel above the deck.

10. A process adapted for continuously processing a flowable solid material, comprising the steps of feeding the material into the upper portion of a vessel having a series of vertically spaced generally horizontal decks each having across the deck horizontally spaced zones of closely arranged perforations providing for a substantial flow of gas through the deck and with the zones of perforations separated by spaces which substantially limit the flow of gas through the deck between the zones, blowing a gas into the vessel and progressively upwardly through the zones of perforations to produce a recirculating bed of the material above each deck with an upward flow of the material above the zones of perforations and a downward flow of material within the spaces defined between the zones of perforations, transferring heat relative to the material while the material is flowing upwardly and downwardly within the bed above at least one deck, feeding material from the bed above a lower deck out of the vessel, directing the gas from above the bed of material above an upper deck out of the vessel.

11. A process as defined in claim 10 wherein the material within the bed above each deck is directed upwardly and downwardly between generally vertically extending and horizontally spaced panel-like heat exchangers, and directing a fluid through the heat exchangers.

12. A process as defined in claim 10 and including the step of agitating the material directly above each deck and within the bottom portion of each bed.

13. A process as defined in claim 10 wherein the zones of perforations within each deck and the separating spaces comprise generally concentrically spaced and generally annular zones and spaces to produce generally concentric annular zones of recirculating material.

14. A process as defined in claim 10 and including the steps of directing a portion of the material downwardly through a lower deck, and back-mixing the material directed downwardly with the material fed into the vessel above an upper deck.

15. Apparatus adapted for processing a flowable solid material, comprising a vertically extending vessel, at least one deck within said vessel, said deck having horizontally spaced zones of closely arranged perforations across said deck to provide for a substantial flow of gas through said deck and with said zones of perforations separated by corresponding spaces which substantially limit the flow of gas through said deck between said zones, means for feeding the material into said vessel above said deck, a blower for directing a flow of gas upwardly through said zones of perforations within said deck to produce a recirculating bed of material above said deck with an upward flow of material above said zones of perforations and a downward flow of material within the spaces defined between said zones of perforations, means for processing the material while the material is flowing upwardly and downwardly above said deck, and means for directing the material from the bed above said deck out of said vessel.

16. Apparatus as defined in claim 15 and including a series of generally vertically extending and horizontally spaced panel-like members disposed above said deck between said zones of perforations for directing the material as the material flows upwardly above said zones of perforations and downwardly within said spaces defined between said zones.

17. Apparatus as defined in claim 15 wherein said panel-like members comprise heat exchangers defining passages for circulating a heat exchange fluid.

18. Apparatus as defined in claim 15 where in said zones of perforations within said deck and said spaces between said zones comprise generally concentrically spaced said zones and spaces for producing generally concentric zones of recirculating material.

19. Apparatus adapted for continuously processing a flowable solid material, comprising a vertically extending vessel, a plurality of vertically spaced decks within said vessel, each of said decks having horizontally spaced zones of closely arranged perforations across said deck to provide for a substantial flow of gas through said deck and with said zones of perforations separated by spaces which substantially limit the flow of gas through said deck between said zones, means for feeding the material into said vessel above the uppermost said deck, blower means for directing a flow of gas upwardly through said zones of perforations within each said deck to produce a recirculating bed of the material above each said deck with an upward flow of the material above said zones of perforations and a downward flow of material within said spaces defined between said zones of perforations, means for processing the material while the material is flowing upwardly and downwardly above each said deck, means for feeding the material from the bed above at least one of said decks downwardly to the bed of material above a lower said deck for efficiently processing the material as the material progresses downwardly within said vessel, and means for directing the material from the bed above a lower said deck out of said vessel.

20. Apparatus as defined in claim 19 where in said processing means comprise a series of vertically extending and horizontally spaced panel-like heat exchangers disposed above at least one of said decks between said zones of perforations, and means for directing a fluid through said heat exchangers for transferring heat relative to the material as the material flows upwardly and downwardly between said heat exchangers.

21. Apparatus as defined in claim 20 and including means for agitating the material above said one deck and below said heat exchangers.

22. Apparatus as defined in claim 19 where in said zones of perforations within each said deck and said spaces comprise generally concentrically spaced said zones and spaces for producing generally concentric zones of recirculating material.

23. Apparatus as defined in claim 19 and including a cyclone separator, means for directing the gas from above an upper bed of material within said vessel to said cyclone separator for separating solid particles of the material from the gas within said separator, and means for directing clean gas from said separator to said blower means to form a recirculating gas flow system.

24. Apparatus as defined in claim 19 and including a heat exchanger connected to heat the gas discharged from said blower means and prior to directing the air into said vessel.

25. Apparatus as defined in claim 19 and including means for directing a portion of the material downwardly through a lower said deck, and conveyor means for back-mixing the portion of material with the material fed into said vessel.

* * * * *